US005366434A

United States Patent [19]

Green, Jr.

[11] Patent Number: 5,366,434

[45] Date of Patent: Nov. 22, 1994

[54] FOLDING APPARATUS FOR NARROW PAPER

[75] Inventor: Robert L. Green, Jr., Hillsboro, Ohio

[73] Assignee: G. Fordyce Company, Inc., Hillsboro, Ohio

[21] Appl. No.: 973,051

[22] Filed: Nov. 6, 1992

[51] Int. Cl.[5] ..... B65H 45/107; B65H 45/20

[52] U.S. Cl. ..... 493/414; 493/412

[58] Field of Search ..... 493/410, 411, 412, 413, 493/414, 415

[56] References Cited

U.S. PATENT DOCUMENTS

| | | | |
|---|---|---|---|
| 1,290,800 | 1/1919 | Teall | 493/413 |
| 2,098,427 | 11/1937 | Menschner . | |
| 2,643,878 | 6/1953 | Lach | 493/413 |
| 3,083,010 | 3/1963 | Salmon et al. . | |
| 3,124,350 | 3/1964 | Huffman . | |
| 3,499,643 | 3/1970 | Biggar, Jr. . | |
| 3,674,254 | 7/1972 | Welch | 493/413 |
| 3,889,940 | 6/1975 | Jakob . | |
| 3,912,252 | 10/1975 | Stephens . | |
| 4,045,012 | 8/1977 | Jakob . | |
| 4,151,985 | 5/1979 | Gladow . | |
| 4,277,058 | 7/1981 | Biggar, III . | |
| 4,332,581 | 6/1982 | Thompson . | |
| 4,401,428 | 8/1983 | Thomas et al. . | |
| 4,512,561 | 4/1985 | Ury . | |
| 4,522,619 | 6/1985 | Bunch | 493/415 |
| 4,547,184 | 10/1985 | Bunch | 493/414 |
| 4,618,340 | 10/1986 | Meschi . | |
| 4,730,762 | 3/1988 | Felix . | |
| 5,084,000 | 1/1992 | Fordyce . | |
| 5,201,700 | 4/1993 | Meschi | 493/415 |
| 5,248,291 | 9/1993 | DeNoon et al. | 493/410 |

FOREIGN PATENT DOCUMENTS

| | | | |
|---|---|---|---|
| 2312442 | 1/1977 | France . | |
| 555995 | 2/1957 | Italy | 493/415 |
| 894791 | 4/1962 | United Kingdom . | |
| 988080 | 4/1965 | United Kingdom . | |

*Primary Examiner*—William E. Terrell

*Attorney, Agent, or Firm*—Ruden, Barnett, McClosky, Smith, Schuster & Russell

[57] ABSTRACT

A zig-zag folding apparatus which includes a swing chute movable in a forward and rearward direction to transmit narrow sheet material between spaced, forward and rearward folding stations. A sheet folding device is located at each of the folding stations which includes a chain carrying a series of paddles, and a drive train which rotates the chain and paddles with respect to the folding station. In the course of moving in a forward and rearward direction, the swing chute transmits the narrow sheet material into contact with beaters or knock-down fingers located at each folding station which direct the sheet into a folding position where the paddles carried by the chain operate to fold or crease the sheet material along its perforations and thus form a stack of zig-zag folded sheets.

4 Claims, 3 Drawing Sheets

FOLDING APPARATUS FOR NARROW PAPER

FIELD OF THE INVENTION

This invention relates to folding apparatus, and, more particularly, to a zig-zag folding apparatus for folding relatively narrow paper stock such as labels, tickets, and similar items.

BACKGROUND OF THE INVENTION

High speed printing machines have been developed in recent years for printing data on computer paper, business forms, labels, tickets and the like. The paper supplied to such printers is provided in webs of indeterminate length formed with longitudinally spaced, transversely oriented perforations. The paper is fed at high speeds from the web to the printer which prints the desired information on the individual sheets formed between adjacent perforations, and then discharges the printed sheets for further handling. In order to convert the continuous length of paper from the printer into a form which can be handled and shipped, the paper must be folded along its perforations as it is discharged from the printer. One type of folding apparatus intended for use with high speed printers is a spiral, zig-zag folder.

Spiral zig-zag folders include a series of rollers which receive the continuous length of paper from the web and guide it to a reciprocating swing chute mechanism. The swing chute is driven forwardly and rearwardly relative to the frame of the folder through a distance or throw which is proportional to the distance between the longitudinally spaced, transverse perforations in the paper. At both the forward and rearward limit of the throw of the swing chute, a set of beaters or knock-down fingers engages the paper in the area of its perforations and forces it into contact with one or more rotating spirals. These spirals resemble a screw having threads which are spaced progressively closer together from top to bottom. The paper is forced by the knock-down fingers into the wider threads at the top portion of the spirals, and, as the spirals rotate, the paper is transferred to progressively narrower threads thus forming a crease in the paper along its perforations. The resulting zig-zag folded sheets are then discharged from the spirals onto a ramp or shelf for stacking.

In addition to operating at high speeds, present day printers are also capable of accommodating different webs of paper, each having different widths and/or different spacing between the transverse perforations. Narrow sheet material, such as labels, tickets and similar items, may have a width as small as 1½ inches. While printers are capable of handling narrow stock, it has been found that spiral, zig-zag folders of the type described above are ineffective in folding stock less than about 4½ inches in width. Such difficulty in handling narrow stock can be attributed to the imposition of side-to-side vectors or forces on the sheet material by the rotating spirals as the crease is formed along the perforations between adjacent sheets. As noted above, the sheet material is directed by the knock-down fingers to the spirals which rotate in order to form the crease along the perforations. In the course of rotating, the spirals impart side-to-side vectors or forces to the sheet material tending to move the sheet material in a side-to-side direction with respect to the frame of the folder. This can cause the sheet material to disengage the spirals and/or create alignment problems which results in either an incomplete fold along the transverse perforations or jamming of the folder.

SUMMARY OF THE INVENTION

It is therefore among the objectives of this invention to provide a folding apparatus which is capable of zig-zag folding narrow sheet material to form a well defined crease at the perforation between adjacent sheets, which avoids jamming of the folding apparatus and which is reliable in operation.

These objectives are accomplished in a zig-zag folding apparatus which includes a swing chute movable in a forward and rearward direction to transmit narrow sheet material between spaced, forward and rearward folding stations. A sheet folding device is located at each of the folding stations which includes a chain carrying a series of paddles, and a drive train which rotates the chain and paddles with respect to the folding station. In the course of moving in a forward and rearward direction, the swing chute transmits the narrow sheet material into contact with beaters or knock-down fingers located at each folding station which direct the sheet into a folding position where the paddles carried by the chain operate to fold or crease the sheet material along its perforations and thus form a stack of zig-zag folded sheets.

The operation of the folding apparatus of this invention is predicated upon the concept of applying an essentially vertically directed force to the sheet material to form a well defined crease along the perforation between adjacent sheets. At each of the folding stations, the drive train which drives the chain is effective to position a first paddle in an essentially horizontal position as the swing chute carries the sheet material to such folding station. The fingers or beaters urge the paper atop the horizontally oriented paddle such that one sheet of the stack rests atop the horizontal paddle and an adjacent sheet, separated from the first sheet by a perforation therebetween, is located vertically above such first sheet. The drive train then operates to quickly advance the chain such that a second paddle moves in an essentially vertical direction toward the horizontally oriented, first paddle at the folding station and into contact with the adjacent sheet. The adjacent sheet of paper is thus forced vertically downwardly by the second paddle and is "squeezed" in between the first and second paddles to form a sharply defined crease along the perforation therebetween.

After the two adjacent sheets at the folding station are folded, the drive train advances the chain to move the horizontally oriented, first paddle away from the folding station while the second paddle takes its place, i.e. the second paddle now becomes the horizontally oriented paddle for purposes of forming a fold on the next two adjacent sheets to be folded. The movement of the paddles carried by the chain at each of the forward and rearward folding stations is timed with the forward and rearward movement of the swing chute such that a set of first and second paddles is advanced into proper position each time the swing chute moves the sheet material to a folding station.

An important aspect of this invention is that each set of first and second paddles apply an essentially vertically directed force on adjacent sheets within the web of sheet material in the course of forming a crease therebetween. This is because the chain advances the second paddle vertically downwardly relative to the horizontally oriented first paddle thus generating essentially no side-to-side or rotational forces on the sheets, unlike zig-zag folding devices employing rotating spirals. As a result, narrow sheet material, such as labels, tickets and the like, can be effectively folded without jamming of the folding apparatus.

In the presently preferred embodiment, the drive train which controls the movement of the chain and paddles comprises a series of intermeshing gears, including a pair of gears which rotate in tandem but have centers which are offset from one another. This pair of gears, in combination with the other gears within the drive train, control the movement of the chain and, hence, the position and movement of the paddles at the folding stations. In particular, the gear train provides a "dwell" at the folding station so that the horizontally oriented first paddle and the adjacent, second paddle are separated from one another to form a space for receipt of the paper. Additionally, such dwell allows the second paddle to move rapidly toward the horizontal paddle in order to form a crease in the paper in timed sequence with the delivery of the paper at the folding station by the swing chute.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
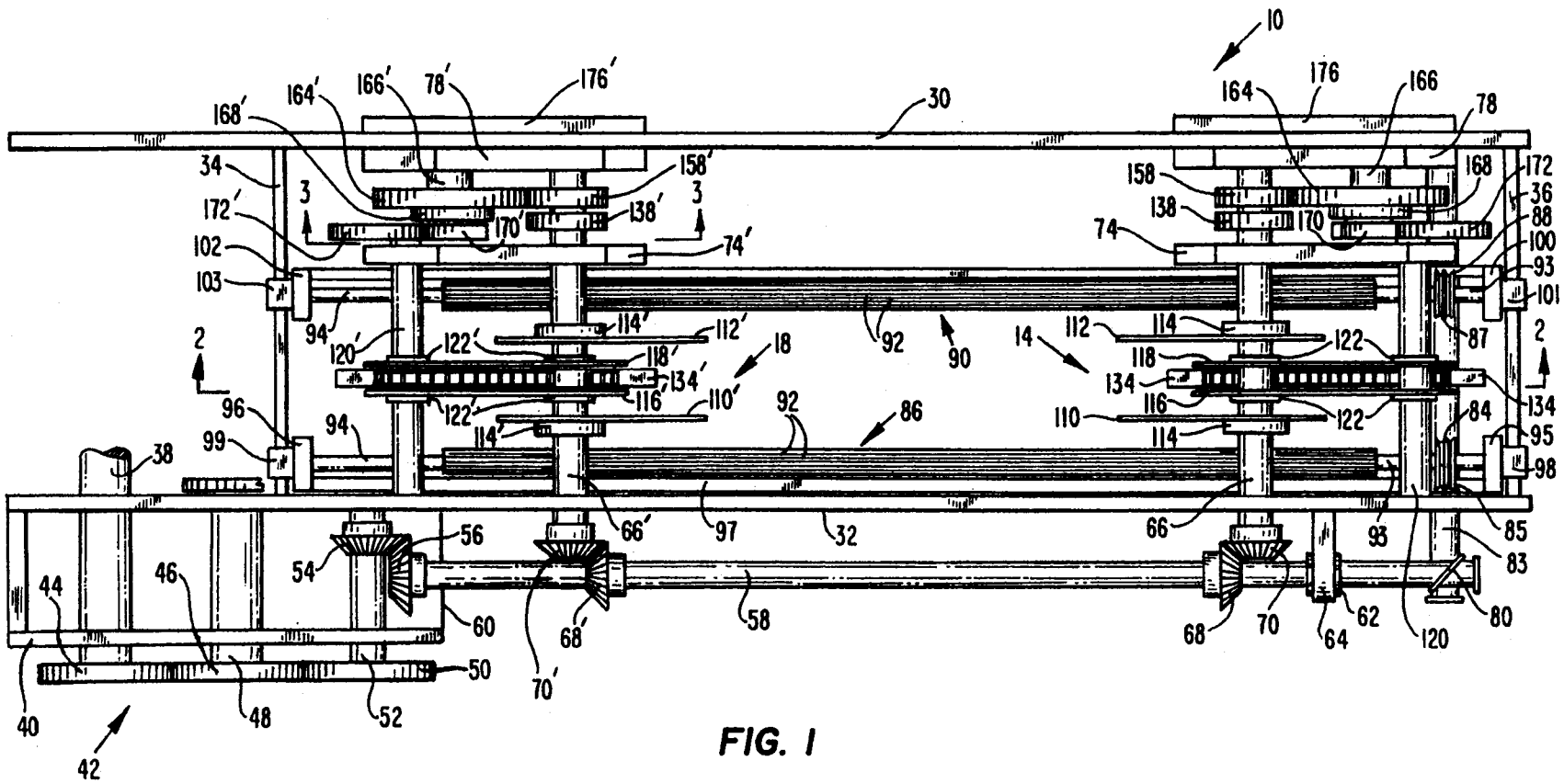
FIG. 1 is a top plan view of a portion of a zig-zag folder incorporating the folding apparatus of this invention.
Figure 2:
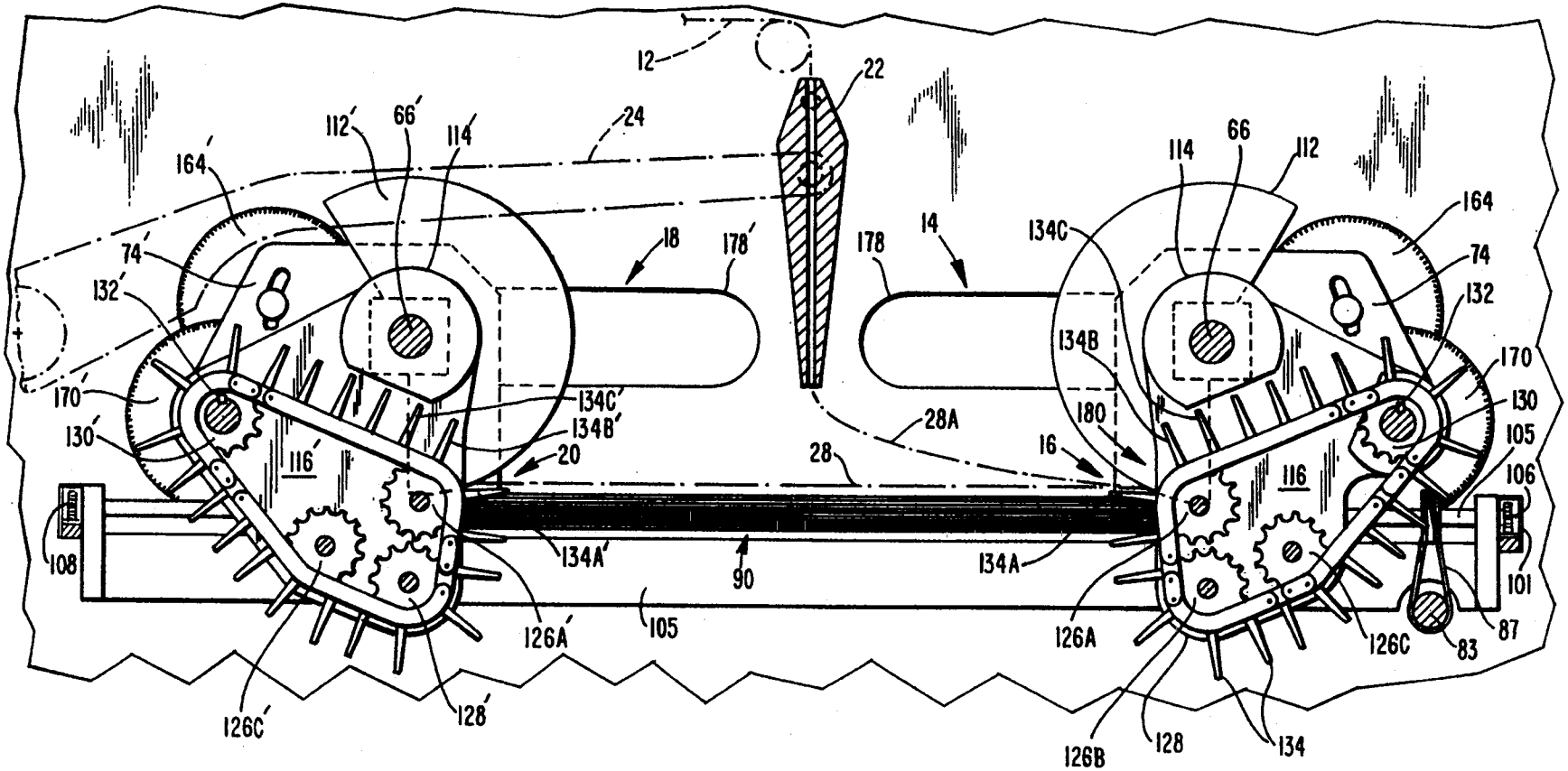
FIG. 2 is a cross-sectional view of a portion of the folding apparatus taken generally along line 2—2 of FIG. 1.

Referring now to FIGS. 1 and 2, a portion of the folding apparatus 10 of this invention is illustrated which depicts the mechanisms for folding a length of paper 12 having longitudinally spaced, transversely oriented perforations. The folding apparatus 10 generally comprises a forward folding assembly 14 adjustably located at a forward folding station 16, a rearward folding assembly 18 adjustably located at a rearward folding station 20 and a swing chute 22 movable in a forward and rearward direction between the folding stations 16, 18 in response to operation of a swing chute drive arm 24. As discussed in more detail below in connection with a description of the operation of apparatus 10, the swing chute 22 carries the paper 12 forwardly and rearwardly to a folding position at the respective folding stations 16 and 18 where a fold 26 is formed between adjacent sheets 28 and 28A of paper 12 having a perforation therebetween.

For purposes of the present discussion, the detailed construction of the forward folding assembly 14 is described herein, it being understood that the rearward folding assembly 18 is structurally and functionally identical. Structure found in the rearward folding assembly 18 which is common to that of the forward folding assembly 14 is given the same reference number with the addition of a "′" in the Figs. The overall construction of apparatus 10 is first discussed followed by a detailed description of the structure of the folding assembly 14, including its drive train.

Overall Construction of Apparatus

The apparatus 10 includes a pair of opposed frame sidewalls 30 and 32 which are interconnected by a rear support rack 34 and forward support rack 36. For purposes of the present discussion, the term "forward" is meant to refer to the righthand portion of the apparatus 10 as depicted in FIG. 1, and the term "rearward" refers to the opposite or lefthand side of apparatus 10. The term "side" or "side-to-side" is meant to refer to a direction between the frame sidewalls 30, 32. Additionally, the terms "upwardly" and "vertically upwardly" are meant to refer to the top or upper portion of the apparatus 10 as depicted at the top of FIG. 2, whereas the terms "downwardly" and "vertically downwardly" are meant to refer to the opposite direction toward the bottom of the apparatus 10 as depicted in FIG. 2.

A main drive shaft 38 is drivingly connected to the output of a motor (not shown) and is journalled to the wall 40 of a gear box 42 carried by the frame sidewall 32. The end of drive shaft 38 located at the sidewall 40 mounts a drive gear 44 which meshes with an idler gear 46 mounted on a shaft 48 connected between the frame sidewall 32 and outer sidewall 40. In turn, the idler gear 46 meshes with a driven gear 50 mounted to a stub shaft 52 which is journalled at one end to swing chute drive arm 24 and at the opposite end to the drive gear 50. The shaft 52, and swing chute drive arm 24, control the forward and rearward movement of swing chute 22 as disclosed in U.S. Pat. No. 5,084,000, owned by the assignee of this invention, the disclosure of which is incorporated by reference in its entirety herein.

The stub shaft 52 mounts a drive bevel gear 54 which is drivingly connected to a driven bevel gear 56 mounted at one end of a secondary drive shaft 58. This secondary drive shaft 58 is journalled to an end plate 60 of gear box frame 42, and is carried at its opposite end by a bearing 62 mounted within a block 64 connected to frame sidewall 32. The purpose of secondary drive shaft 58 is to drive a gear drive shaft 66 associated with forward folding assembly 14 and a gear drive shaft 66′ associated with rearward folding assembly 18. As noted above, for purposes of the present discussion, only the structure and operation of forward folding assembly 14 is described herein, it being understood that rearward folding assembly 18 is structurally and functionally identical except that the gear drive shaft 66′ rotates in the opposite direction from that of gear drive shaft 66.

As depicted on the righthand portion of FIG. 1, the secondary drive shaft 58 mounts a drive bevel gear 68 which meshes with a driven bevel gear 70 carried on one end of the gear drive shaft 66. The gear drive shaft 66 is rotatably carried within a bearing (not shown) in the frame sidewall 32 and extends across the width of apparatus 10 where its opposite end is rotatably carried in a bearing 72 mounted in an inner gear mounting plate 74 and a bearing 76 mounted in an outer gear mounting plate 78. See also FIG. 4. These bearings 72, 76 are each retained within mounting plates 74, 78 by a snap ring 79. The term "inner" is meant to refer to a direction toward the center of apparatus 10 as depicted in FIG. 1, whereas the term "outer" is meant to refer to the opposite direction toward the frame sidewalls 30 or 32 of apparatus 10.

The secondary drive shaft 58 terminates at the forward end of apparatus 10 where it is drivingly connected by a belt 80 to a pulley (not shown) carried by a roller drive shaft 83. In turn, the roller drive shaft 83 is connected by a belt 84 to a pulley 85 mounted at one end of a first fluted roller 86, and by a belt 87 to a pulley 88 mounted at one end of a second fluted roller 90. As depicted in FIGS. 1 and 2, the fluted rollers 86, 90 are each formed with longitudinally extending channels 92, except for their forward end portion 93 and rearward end portion 94. The forward end portion 93 of fluted roller 86 is mounted in a bearing 95, and its rearward end portion 94 is mounted in a bearing 96. These bearings 95, 96 mount a side plate 97 along a side edge thereof, and each bearing 95, 96 mounts a cover plate 98, 99, respectively. Similarly, the forward end portion 93 of fluted roller 90 is mounted in a bearing 100 carried by a cover plate 101, and the rearward end portion 94 thereof is mounted in a bearing 102 carried by a cover plate 103 along the rearward support rack 34. The bearings 100, 102 support a side plate 105.

Preferably, the forward end 93 of each of the fluted rollers 86 and 90, respectively, mounts a pinion gear 106 which is mateable with the forward support rack 36 and contained within the cover plates 98 and 101. The rearward end 94 of fluted rollers 86 and 90 each mount a pinion gear 108 mateable with the rearward support rack 34 which are housed within the cover plates 99 and 103. An adjustment member (not shown) associated with each pinion gear 106 at the forward end of apparatus 10 is effective to move the fluted rollers 86, 90 laterally, i.e. in a side-to-side direction along the support racks 34, 36, toward and away from one another to thus vary the lateral spacing therebetween. As described in more detail below, the purpose of the fluted rollers 88, 90 is to support the side edges of the paper 12 as it is being folded by the forward and rearward folding assemblies 14, 18, and to assist in transmitting the folded sheets downwardly to a ramp (not shown) where the folded sheets can be collected and stacked. Side-to-side movement of the fluted rollers 86, 90 is required to adjust their relative position and thus accommodate papers 12 of varying widths.

Folding Assemblies

With reference to FIG. 2, and the center portion of FIG. 1, the forward and rearward folding assemblies 14 and 18 are illustrated in detail. Only the forward folding assembly 14 is described herein, being understood that the rearward folding assembly 18 is structurally and functionally identical.

As noted above, the secondary drive shaft 58 is drivingly connected by bevel gears 68 and 70 to a gear drive shaft 66. The center portion of gear drive shaft 66 mounts a pair of knock-down fingers 110 and 112, each of which are fixed to the gear drive shaft 66 by a separate block 114. In between the knock-down fingers 110, 112 are a pair of chain mounting plates 116 and 118, each having a rearward end carried by the gear drive shaft 66 and a forward end carried by a chain drive shaft 120 which is described in more detail below. The chain mounting plates 116, 118 remain in a rotatably fixed position with respect to the shafts 66 and 120 and are held in position thereon by bearing blocks 122. Extending between the chain mounting plates 116, 118 are three pins which mount a first idler sprocket 126A, a second idler sprocket 126B and a third idler sprocket 126C, respectively. An endless chain 128 is trained around idler sprockets 126A, 126B, 126C, and around a drive sprocket 130 rotatably mounted to the chain drive shaft 120 by a key 132. In response to rotation of chain drive shaft 120, the drive sprocket 130 causes the chain 128 to rotate about sprockets 126A, 126B and 126C for purposes to become apparent below. The chain 128 mounts a number of spaced, vertically upright pins or paddles 134 which extend outwardly therefrom and are movable with chain 128 relative to the forward folding station 16. Preferably, each paddle 134 gradually decreases in thickness from its base, which mounts to the chain 128, to its tip. This configuration has been found to assist in the folding operation as noted below.

Figure 4:
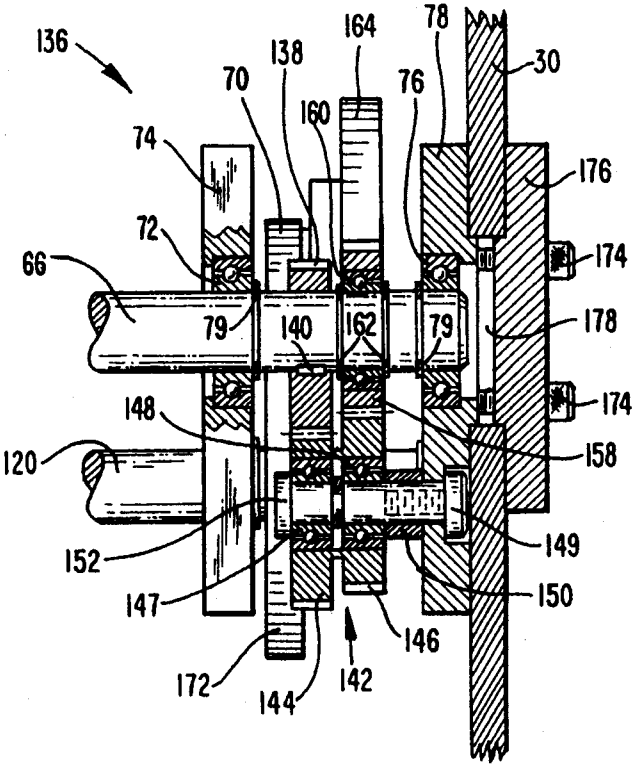
FIG. 4 is a cross-sectional view of a portion of the chain drive taken generally along line 4—4 of FIG. 3.
Figure 3:
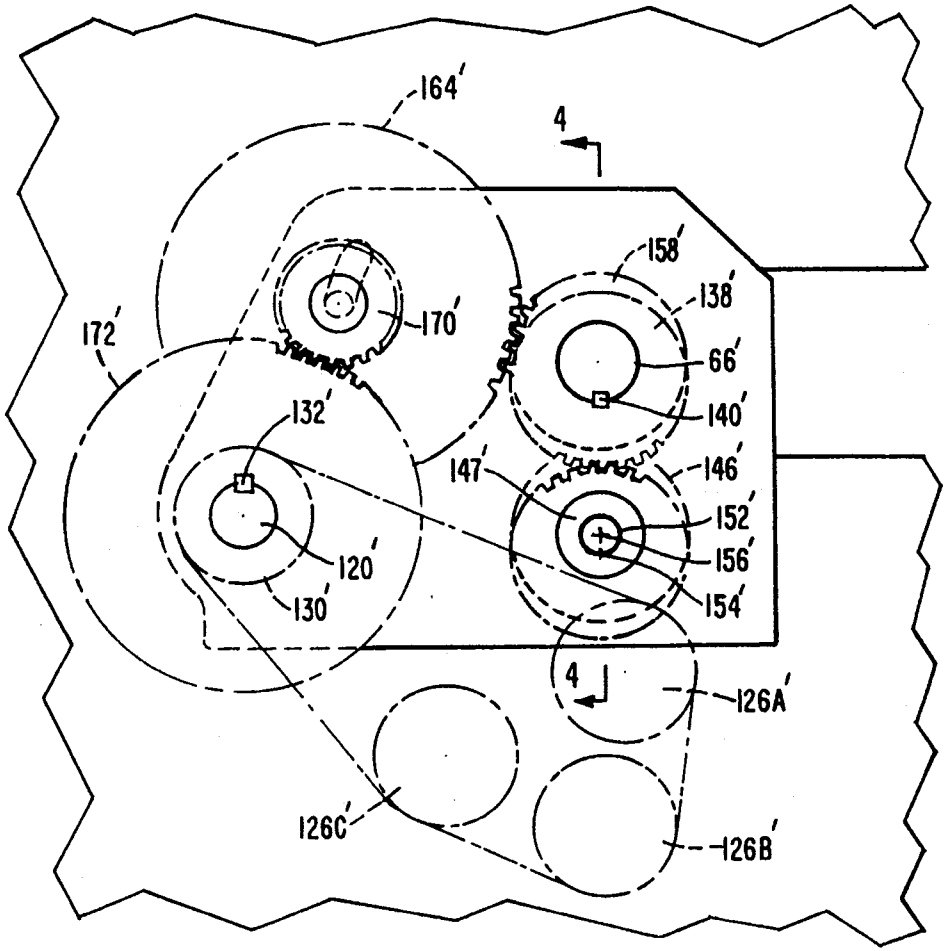
FIG. 3 is a cross-sectional view taken generally along line 3—3 of FIG. 1 depicting a portion of the chain drive.

With reference to FIGS. 3 and 4, a gear drive train 136 is illustrated whose function is to control the movement of chain 128, and the paddles 134 carried thereon, relative to the forward folding station 16 in timed relation to the movement of swing chute 22 in order to form a well defined fold along the perforation between, for example, adjacent sheets 28 and 28A. The gear drive train 136 comprises a drive gear 138 which is connected by a key 140 to the gear drive shaft 66. The drive gear 138 meshes with a tandem gear 142 which comprises an inner gear 144 welded or otherwise permanently affixed to an outer gear 146. As best shown in FIG. 4, the inner and outer gears 144 and 146 have a common axis of rotation, but their center lines are offset from one another. The inner and outer gears 144, 146 are each rotatably mounted by bearing 147, 148, respectively, on a pin 149 which extends outwardly from the outer gear mounting plate 78 through a spacer 150 toward the inner gear mounting plate 74 where it terminates with a flange 152. As also shown in FIG. 3, the center line 154' of inner gear 144' is located vertically beneath the center line 156' of outer gear 146'. As described below, this offset of the centers of gears 144, 146, and 144', 146', provides a dwell or delay in the movement of chains 128, 128' which is required to obtain proper movement and synchronization of the paddles 134 relative to the paper 12 placed at the forward folding station 16 by the swing chute 22.

The outer gear 146 of tandem gear 142 meshes with an idler gear 158 which is rotatable relative to the gear drive shaft 66 on a bearing 160, and is held in place thereon by snap rings 162. In turn, the idler gear 158 meshes with a larger diameter, driven gear 164 rotatably carried on a stub shaft 166 connected to the outer gear mounting plate 78. See FIG. 1. The driven gear 164 is connected by a spacer 168 to a smaller diameter gear 170 which, in turn, meshes with a drive gear 172 keyed to the chain drive shaft 120. As a result, rotation of the gear drive shaft 66 is transmitted through the gear train 136 to the chain drive shaft 120 to effect rotation of the chain 128 and paddles 134 carried thereon.

One further aspect of each of the forward and rearward folding assemblies 14 and 18 is the capability of forward and rearward adjustment along the frame sidewalls 30 and 32 so as to position the forward folding station 16 and rearward folding station 20 closer together or further apart and thus accommodate paper 12 having differing longitudinal spacing between adjacent perforations. As shown in FIG. 4, the outer gear mounting plate 78 is connected by screws 174 to a cover plate 176 positioned along the outer surface of frame sidewall 30. The screws 174 extend through an elongated, adjustment slot 178 formed in the sidewall 30. In order to adjust the forward and/or rearward position of the forward folding assembly 14 along the frame sidewalls 30, 32, the screws 174 are first loosened, thus allowing the outer gear mounting plate 78 and cover plate 176 to slide along the frame sidewall 30 to the desired position, after which time the screws 174 are tightened in preparation for operation.

Operation of Apparatus 10

With reference to FIG. 2, the operation of apparatus 10 proceeds as follows. As noted above, the swing chute 22 is movable forwardly and rearwardly between the forward folding station 16 and rearward folding station 20. The extent of such forward and rearward motion of swing chute 22 is controlled by the swing chute drive arm 24 as discussed in U.S. Pat. No. 5,084,000 to Fordyce. As described in U.S. Pat. No. 5,084,000, the "throw" or extent of forward and rearward movement of swing chute 22 is such that the longitudinally spaced, transversely extending perforations between adjacent sheets are placed in a position for folding at each of the forward and rearward folding stations 16, 18.

With reference to the righthand portion of FIG. 2, the swing chute 22 is illustrated in position where it has just transferred the paper 12 to the forward folding station 16 so that a fold or crease can be made along the perforation between individual sheets 28 and 28A. The swing chute 22 is shown in the process of moving in a rearward direction, toward the rearward folding station 20, to position the next two adjacent sheets of paper 12 thereat so that the rearward folding assembly 16 can effect a fold at the perforation therebetween.

With reference to the righthand portion of FIG. 2, a fold between adjacent sheets 28 and 28A is accomplished as follows. Initially, the knock-down fingers 110 and 112 carried by gear drive shaft 66 are rotated to engage the sheet 12 at the forward folding station 16. The knock-down fingers 110, 112 function to direct the sheets 28 and 28A toward the chain 128 and the paddles 134 carried thereon. An important aspect of this invention is the control of the movement of chain 128, and, hence, the paddles 134 in timed relation with the movement of swing chute 22 to the forward folding station 16. As depicted in FIG. 2, the formation of a fold or crease at the perforation between sheets 28 and 28A is accomplished by a first paddle 134A and an adjacent paddle 134B. The gear drive train 136 is effective to move the chain 128 so that the paddle 134A is oriented in a generally horizontal position at the forward folding station 16 before the swing chute 22 transmits the adjacent sheets 28, 28A of paper 12 to the forward folding station 16. The swing chute 22, in cooperation with knock-down fingers 110, 112, deposit the sheets 28 and 28A at the forward folding station 16 such that the sheet 28 is placed atop the horizontal paddle 134A and the adjacent sheet 28A is spaced vertically above the sheet 28. In order to ensure that there is a sufficient gap 180 between horizontal paddle 134A and the next paddle 134B, the gear drive train 136 described above provides a "dwell" or temporary delay in the movement of chain 128 when the paddle 134A reaches the forward folding station 16. This permits the adjacent sheets 28 and 28A to be deposited at the forward folding station 16 without interference from the paddle 134B. As noted above, such "dwell" is effected by the inner and outer gears 144, 146 of tandem gear 142 in combination with the remaining gears of the gear drive train 136.

Once the sheets 28 and 28A have been deposited at the forward folding station 16, with the sheet 28 atop the horizontally oriented, first paddle 134A, the swing chute 22 reverses direction and moves rearwardly toward the rearward folding station 20. The gear drive train 136 then rapidly advances the chain 128, which, in turn, moves the adjacent paddle 134B vertically downwardly toward the horizontal, first paddle 134A at the folding station 16. The sheets 28 and 28A are essentially "squeezed" between paddles 134A and 134B forming a well defined crease or fold at the perforation therebetween. The paddles 134A and 134B do not make contact with one another, but are moved toward one another to form the crease at the perforation. The shape of paddles 134A, 134B aids in this process since the paddles 134A, 134B progressively increase in thickness from their tip to their base, and, hence, are nearer one another as the paper moves toward the chain 128 which mounts the paddles 134. Importantly, the folding or creasing force exerted by the paddles 134A and 134B is essentially vertical in direction without side-to-side force vectors, due to the vertical movement of paddle 134B relative to horizontally oriented paddle 134A, so that the narrow paper 12 can be effectively folded.

After the sheets 28 and 28A have been folded between paddles 134A and 134B, the chain 128 is advanced to move the paddle 134B to a horizontal position at the folding station 16 in preparation for a subsequent folding operation on two more adjacent sheets along the length of paper 12. In timed sequence with the movement of chain 128 and paddles 134A, 134B, the swing chute 22 deposits the next two sheets atop the now horizontally oriented paddle 134B in preparation for folding by such paddle 134B and the next paddle 134C along chain 128. This folding process takes place at each of the forward and rearward folding assemblies 14 and 18, in sequence with the forward and rearward movement of swing chute 22, so that the folding of paper 12 is essentially continuous during the operation of apparatus 10.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. Apparatus for zig-zag folding a length of paper having longitudinally spaced, transversely oriented perforations, comprising:

a frame having forward and rearward ends, opposed sides and a main drive shaft;

a swing chute which receives the length of paper, said swing chute being drivingly connected to said main drive shaft for movement in a forward and rearward direction between spaced first and second folding stations;

sheet folding device located at each of said first and second folding stations, each of said sheet folding devices including:

(i) a drive sprocket and at least one idler sprocket;

(ii) an endless chain connected to said drive sprocket and to said at least one idler sprocket, said endless chain mounting a number of spaced paddles and being effective to move said paddles with respect to one of said first and second folding stations between a substantially vertical folding position and a substantially horizontal folding position;

(iii) a series of interconnected gears, one of said gears being drivingly connected to said main drive shaft and another of said gears being directly connected to said drive sprocket, said series of interconnected gears being effective to control the speed of rotation of said drive sprocket to provide a delay in the movement of each of said paddles upon reaching said substantially vertical folding position, and to then rapidly move each of said paddles from said substantially vertical folding position to said substantially horizontal folding position.

2. The apparatus of claim 1 in which each of said paddles has a tip and a base which mounts to said chain, each of said paddles progressively increasing in thickness from said tip to said base thereof.

3. The apparatus of claim 1 in which said series of interconnected gears includes a first gear and a second gear which are interconnected such that the center of said first gear is offset from the center of said second gear, said first and second gears being rotatable about a common axis of rotation.

4. The apparatus of claim 1 further including means for adjusting the relative position of each of said sheet folding device, in a forward and rearward direction, to vary the distance between said first and second folding stations.

* * * * *